US005441579A

United States Patent [19]

Kaufman et al.

[11] Patent Number: 5,441,579

[45] Date of Patent: Aug. 15, 1995

[54] METHOD OF RECYCLING SCRAP METAL

[76] Inventors: Sydney M. Kaufman, 37725 Lakewood Cir., #201, Westland, Mich. 48185; Stephen E. LeBeau, 41512 Ladywood Ct., Northville, Mich. 48167

[21] Appl. No.: 94,065

[22] PCT Filed: Jan. 31, 1992

[86] PCT No.: PCT/US92/00807

§ 371 Date: Jul. 28, 1993

§ 102(e) Date: Jul. 28, 1993

[87] PCT Pub. No.: WO92/13664

PCT Pub. Date: Aug. 20, 1992

Related U.S. Application Data

[63] Continuation-in-part of Ser. No. 650,364, Feb. 1, 1991, abandoned, Ser. No. 650,365, Feb. 1, 1991, Pat. No. 5,152,847, and Ser. No. 650,378, Feb. 1, 1991, abandoned.

[51] Int. Cl.[6] ..... B22F 1/00; B22F 3/00

[52] U.S. Cl. ..... 148/233; 75/247

[58] Field of Search ..... 148/233; 75/211, 247

[56] References Cited

U.S. PATENT DOCUMENTS

| | | | |
|---|---|---|---|
| Re. 22,452 | 3/1944 | Clements et al. | 75/22 |
| 3,925,109 | 12/1975 | Nilsen | 148/16 |
| 4,011,077 | 3/1977 | Kaufman | 75/212 |
| 4,090,874 | 5/1978 | Kaufman | 75/246 |
| 4,106,931 | 8/1978 | Nayar | 75/201 |
| 4,129,443 | 12/1978 | Kaufman | 75/212 |
| 4,209,326 | 6/1980 | Klein et al. | 75/211 |
| 4,394,980 | 7/1983 | Marz et al. | 241/62 |
| 4,450,017 | 5/1984 | Berger et al. | 148/16 |
| 4,497,671 | 2/1985 | Wasserman et al. | 148/16 |
| 4,547,227 | 10/1985 | Herter | 134/7 |
| 4,614,638 | 9/1986 | Kuroishi et al. | 419/39 |
| 4,799,955 | 1/1989 | McClellan | 75/247 |
| 4,992,233 | 12/1991 | Swaroop et al. | 419/36 |
| 5,041,211 | 8/1991 | Koszalka | 209/164 |
| 5,053,082 | 10/1991 | Flanigan et al. | 134/25.1 |
| 5,080,721 | 1/1992 | Flanigan et al. | 134/26 |

OTHER PUBLICATIONS

Metals Handbook Ninth Edition, vol. 7. p. 361 discussing production sintering practices.

"Production Sintering Atmospheres" by H. S. Nayar in Metals Handbook, Ninth Edition at pp. 339–350.

*Primary Examiner*—Upendra Roy

*Attorney, Agent, or Firm*—Weintraub, DuRoss & Brady

[57] ABSTRACT

A method of embrittling cleaned steel particles is described, followed by a grinding and sorting operation. Depending on the initial carbon content of the steel scrap, a reducing and carbon-containing atmosphere may be provided to carburize the particles as they are being embrittled. A quenching operation is provided at the end of the process to embrittle the particles and before the particles are ground. The ground grit which is produced may then be sorted by size and used as an abrasive compound, or, alternatively may be further ground and annealed in a subsequent operation to provide suitable powder for forming sintered parts. Prior to annealing the grit may be further ground in a partial oxidizing atmosphere to preoxidize the powder, in order to provide oxygen directly within the powder to react with any residual carbon so that the carbon monoxide gas can be formed and the powder can be substantially free of both carbon and oxides when the reaction is complete. Alternatively, the powder may be preheated in a controlled atmosphere prior to annealing to preoxidize the powder.

23 Claims, 4 Drawing Sheets

METHOD OF RECYCLING SCRAP METAL

CROSS REFERENCED TO RELATED APPLICATIONS

The present application is a continuation-in-part of U.S. patent application Ser. No. 650,364 filed Feb. 1, 1991 now abandoned. The present application is also a continuation-in-part of U.S. patent application Ser. No. 650,365, filed Feb. 1, 1991 now U.S. Pat. No. 5,152,847. The present application is also a continuation-in-part of U.S. patent application Ser. No. 650,378, filed Feb. 1, 1991 now abandoned. The disclosures of each of the above-referenced U.S. patent applications are hereby incorporated by reference.

BACKGROUND OF THE INVENTION

1. Field of the Invention

The present invention relates to a method of treating steel particles to produce abrasive grit, and a grit which is a product of the described method. In one aspect of the present invention, the grit, thus, produced is ground into a powder and is further treated to reduce the carbon and oxygen content thereof, so that it is suitable for use in a subsequent sintering operation.

2. Prior Art

In the powdered metal industry, many types of parts may be formed from sintering powdered metal. Metal powder such as that formed from, e.g., steel, is used in the formation of many types of articles of manufacture. This powder is subjected to a variety of processes in order to covert the powder into an article such as, e.g., a gear. Articles of this type each have a measurable hardness, ductility, tensile strength and a variety of other physical characteristics that allow the created articles to be acceptable for a given application.

The metallic powder which is used in the production of these types of articles has a direct impact upon the quality of the finished article. More specifically, the physical characteristics of the article are usually determined by the cleanliness and purity of the powder which, in turn, is related to the powder's overall oxygen content. Generally, for many high performance applications, a steel powder is required which has a relatively low oxygen content in order to produce an article having a high degree of strength. In addition, a low carbon content is often preferable.

U.S. Reissue Pat. No. Re-22,452, issued Mar. 7, 1944 to Clements et al describes a method of making powdered iron or steel in which shredded steel scrap is passed through a carburizing furnace, a quench tank, and a dryer and subsequently is ground up, sorted according to size, and then annealed by passing it through a suitable annealing furnace in which the material is protected by a neutral or reducing atmosphere. However, Clements does not suggest using the grit, which is an intermediate product of the process, for any end use. In addition, the method of Clements does not require cleaning of the feedstock prior to processing.

While the use of metal powders in forming machine parts and the like is a known process, improvements in this process are continuously being sought. In particular, a method of producing a metal powder which is suitable for use in a subsequent sintering operation and which includes components such silicon, manganese, chromium, or vanadium in which oxidation of those compounds is avoided would contribute to the art of powder metallurgy.

SUMMARY OF THE INVENTION

The present invention provides (1) a method of producing an abrasive steel grit material and (2) a steel grit which is the product of the described method.

The method of producing grit in accordance with the present invention, generally, comprises the steps of:

(a) heating clean, dry steel particles in a protective atmosphere which is substantially non-oxidizing at a temperature of about 1500° to about 1800° F. (815° to 1180° C.) until the steel particles attain a carbon content of at least 0.3 percent by weight;

(b) quenching the heated steel particles with water to cause the particles to become brittle;

(c) grinding the steel particles in a mill to form grit; and (d) sorting the grit according to size.

The present invention also provides a method of producing steel powder from the grit, by an annealing process which is suitable for use in a subsequent sintering operation, the steel powder having a low oxygen content. This subsequent powder production, in a preferred embodiment thereof, includes a preoxidation of the powder prior to annealing to facilitate later decarburization of the powder. By using the method of the present invention, steel scrap which contains easily oxidizable constituents, such as silicon, chromium, and magnesium can effectively be used to produce a steel powder which contains minimum amounts of oxides of the above-identified materials, and which is usable to produce sintered parts.

For a more complete understanding of the present invention, the reader is referred to the following detailed description section, which should be read in conjunction with the accompanying drawings. Throughout the following description and in the drawings, like reference numbers refer to like parts throughout the several views in which:

DETAILED DESCRIPTION OF THE PREFERRED EMBODIMENTS

Figure 1:
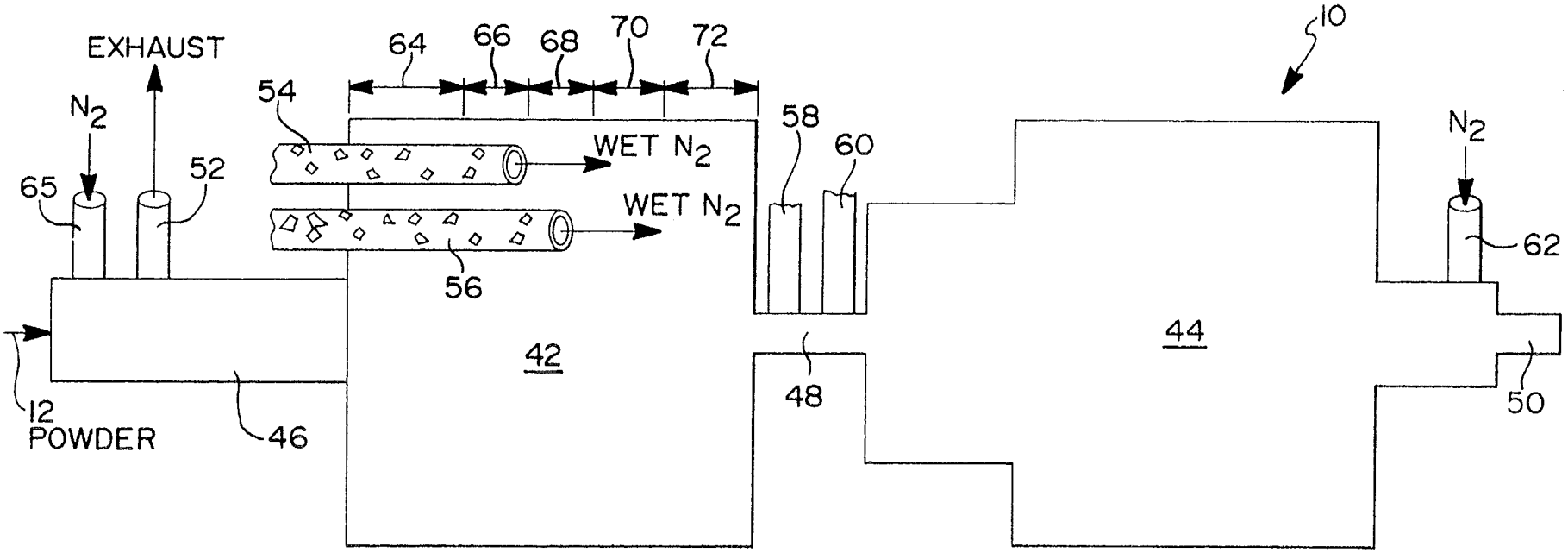
FIG. 1 is a block diagram of the annealing apparatus made in accordance with the teachings of the preferred embodiment of this invention.

The present invention provides a method for forming abrasive steel grit from a raw material 80 which is derived from punchings, turnings, trimmings, shreddings and the like, and preferably which is steel scrap from machining operations. It is essential to the practice of the present invention that such steel scrap be thoroughly cleaned and dried as a preliminary step. A method for cleaning steel scrap is disclosed in parent application Ser. No. 650,378, the disclosure of which is hereby incorporated by reference. The cleaning method described in parent application Ser. No. 650,378 is suitable for use in the practice of the present invention. In the method described in the parent application, scrap steel particulates 80 are cleaned by being sprayed with an aqueous alkaline wash, which preferably includes about 0.3 to about 2 percent by weight of potassium hydroxide. Subsequent to the alkaline solution being applied thereto, the particles may, optionally, be chopped in a shredder 82 and then the particles are thoroughly rinsed and dried in an oven.

The removal of any impurities, (nonmetallic waste, sand, and non-ferrous metals, etc.) is also a prerequisite for producing a quality finished product. The method outlined in parent application Ser. No. 650,378 is also appropriate for the removal of impurities.

However, it must be noted that any conventional cleaning method can be employed herein.

Once the steel chips or particles have been thoroughly cleaned, dried, and any impurities have been removed therefrom, the particles are then embrittled by passing them through an oven or furnace chamber 84 at a temperature of about 1500° C. to about 1800° F. about (about 815° C. to about 1180° C.) in a protective atmosphere which may include nitrogen, hydrogen, $CO_2$, chemically inert gases such as neon, argon, etc., as well as mixtures of the above gases. It is an important feature of the present invention that the atmospheric composition to which the particles are exposed is controlled at virtually every step of the process following the cleaning step in order to strictly control the carbon and oxygen content of the particles. After leaving the oven 84, the steel particles are, next, passed through a water bath or quench 86 to "quench" the materials and to change the microstructure of the material into a martenistic structure. The temperature range and the atmospheric composition sued are both a function of the initial carbon content of the incoming steel scrap. Recycled steel turnings ranging in carbon content from about 0.3 percent to as high as 1.2 percent by weight are acceptable without any addition of carbon thereto during the embrittling process, while lower carbon content materials should be as described herein.

The steel materials are then transported into the integral circulating water bath or quench 86 to embrittle the material, through an alloy chute assembly 88 which is connected to the furnace atmosphere chamber 84. The alloy chute assembly 88 is submerged below the surface of the water to form an atmospheric seal. The material, therefore, does not get exposed to air during transfer from the main furnace chamber to the quench, thus, substantially avoiding oxidation of the materials during the quenching operation.

The discharge of hot steel product into the water bath 84 creates steam which can leak back into the main furnace chamber and adversely effect the atmospheric composition by the addition of water vapor thereto. Accordingly, exhaust fans or vacuum eductors (not shown) directly above the quenching chamber inside the alloy chute assembly are provided to draw the moist steam from the quenching operations away from the furnace chamber. Maintaining the circulating quenched bath 86 at lower temperatures also reduces the amount of steam generated. The preferred temperature range of the water quench is approximately 60° F. to 100° F. (about 15° C. to about 38° C.). Because of this low temperature range, the water does not act as an oxidizing agent at this step.

As noted, if the initial carbon content of the feedstock is approximately 0.3 weight percent or greater, then satisfactory response to the embrittling treatment can be achieved without any carbon additions. In this case, the temperature selected for the embrittling process is the minimum temperature necessary to permit rapid dissolution of the carbon or carbides in the steel. The cycle time for these types of feedstock is the minimum time necessary to put all of the carbon-bearing species into solution, generally, approximately 30 minutes to about one hour. When the carbon content of the feedstock is at least 0.3 percent by weight, the atmospheric composition of the oven is set at a neutral or slightly oxidizing condition. In the case of steel containing chromium, neutral hardening minimizes the pickup of excess carbon which could form undesirable chromium carbides.

However, if the feedstock contains less than 0.3 percent by weight of carbon, the atmospheric composition in the oven is adjusted to provide a reducing atmosphere which contains a gaseous carbon-containing compound. This tends to provide carbon to the feedstock material to increase the desired carbon content for the end product. The carbon-containing compound may be natural gas, or alternatively, may include methanol as a carbon source. The methanol is injected into the furnace, and the heat of the furnace chamber causes instant evaporation of the methanol and may dissociate the methanol into its constituent parts. In the case of carburizing low carbon steel scrap in which the steel is in particle form, the ratio of enriching gas additions to the RX base carrier gas can vary from 1:10 to 1:2 depending on the level of carbon in the incoming material and the production loading used in the furnace. The high surface area of long thin steel turnings being carburized through their entire thickness provides essentially a sponge soaking up any available carbon provided by the atmosphere.

The cycle time for embrittling for low carbon-bearing feedstock is a function of the section thickness of the turnings. Sufficient time must be allowed for the diffusion of carbon through the thickness of the material. The time necessary can be predicted using calculations based on the diffusion rates of carbon and steel at various temperatures. Since the diffusion rates increase with increasing temperature, generally higher temperatures (about 1700° to about 1800° F., about 925° C. to about 1180° C.) are used to embrittle low carbon bearing materials. Generally, the embrittling of the low carbon feedstock ranges from about two to about four hours.

The final carbon content of the end product can be adjusted to match the needs of the desired end product by fixing the carbon potential of the atmosphere.

In the case of intermediate feedstock for producing fine steel powders, the minimum carbon content is that which allows proper response to downstream pulverizing and grinding process steps to reduce the size of the steel in an efficient manner. It is preferred that the intermediate product of the embrittling and carburizing process have a carbon content of at least 0.3 percent by weight.

The performance of coarse abrasives can be modified by adjustment of the carbon levels in the materials. For extreme abrasive cutting which requires maximum hardness of the abrasive, the carbon may be boosted to approximately 0.6 to approximately 1.2 percent. For other applications where abrasive cutting is balanced by a resistance to premature breakdown of the grit to dust during service, a lower carbon content will provide greater toughness in the abrasive.

Although not shown, in one embodiment, the furnace chamber 84 for the embrittling treatment may comprise an inclined cylinder made from cast nickel heat resistant alloys. The cylinder or retort is made to rotate as the product is moved therethrough, and the cycle time may be adjusted by changing the rotational speed of the cylinder.

Again, and although not shown, an alternative to the cylindrical retort furnace is the use of a pusher dump tray type of furnace. In this case, the steel turnings are loaded into foraminous alloy wire mesh trays which are pushed through the furnace sequentially.

The tray does not load continually as does the retort, but so long as the depths in the wire trays do not exceed 6 to 12 inches in depth, it is believed that the heat and atmosphere in the furnace can penetrate throughout the scrap.

Embrittled steel scrap can be ground in a mill 90, which may be a ball mill or a hammer mill and the resultant product can be used as coarse abrasives (from 10 mesh to approximately 200 mesh, 0.075 mm to 2 mm) after pulverizing and screening operations. Powders as small as 2 to 10 microns can be produced by additional grinding or milling techniques, if desired.

It is preferred that the product of the carburizing and/or embrittling process produce a product which has a hardness ranging from Rockwell C55 to Rockwell C70. Hammer milling or other means of impact crushing or grinding are effective given the brittle nature of the material. A single pass through a hammer mill such as that sold by Buffalo Hammer Mill Corporation of Buffalo, N.Y., will provide a usable product in accordance with the present invention, although it is preferred that the abrasive grit which is produced after passage through the hammer mill will be screen-sorted for size before use. Such grit can be commercially useful in the as-quenched and hardened condition, or alternatively, such grit can be tempered to lower its hardness to a controlled level between Rockwell C40 and 60. Tempering is accomplished by heating the material in a temperature range from about 600° F. to about 1200° F. (about 315° C. to about 650° C.) in either air or in a protective atmosphere. Magnetic separation of the product may, optionally, also be performed after the grinding operation.

The grit produced hereby can be employed as an abrasive material for use in grinding wheels, emery cloth sandpaper, etc., depending on the screen size. Alternatively, the grit may be further process.

Accordingly, in the grit produced by the above-described process is further treated by annealing to remove carbon and oxygen therefrom.

In the annealing process according to the present invention, a dry vibratory grinder may be used, such as that available from Palla Industries of Germany using one inch diameter 1090 carbon steel rod in both the upper and lower cylinders of the mill as a grinding medium to further grind the grit into a powder.

The atmosphere in the grinder may also be controlled in order to slightly oxidize the steel powder, where described. When dealing with steel powders, the annealing process is somewhat difficult because it is extremely difficult to decarburize (remove carbon) without oxidizing some or all of the remaining elements. The solid oxide product can act as a hardening agent for the steel as well as prohibiting necessary grain enlargement.

In accordance with the present invention and in order to facilitate decarburization of the powder at a later stage, a preoxidation is carried out prior to the annealing and during the grinding. By preoxidation of the exterior surface of the powder at low temperatures, the amount of oxygen added to the steel powder is near to the precise amount needed to react with all of the carbon in the powder. This allows for simultaneous carbon removal and oxygen removal later in the annealing process by suing the residual carbon in the steel powder to reduce the oxide. This permits rapid removal of both carbon and oxygen throughout the powder bed and is self-extinguishing as one or both of the reactants becomes depleted.

Referring now to FIG. 1, there is shown the annealing methodology and apparatus (i.e., "the system") of a preferred embodiment of this invention which effectively removes carbon from ground steel or metal powder 12 and which further reduces oxidation which may have occurred during the prior grinding or comminuting of the steel. Before describing the operation of system 10 a further explanation of the objects and processes of the invention are needed.

According to the teachings of the preferred embodiment of this invention, the decarburization and annealing of the input powder occurs without substantial simultaneous oxidation of the component metallic elements of powder. That is, steel or metallic powder has previously been difficult to process at elevated temperatures because of its tendency to form stable oxides on the particle surfaces, thereby rendering the powder essentially useless for the later manufacture of pressed and/or sintered articles. In order to alleviate these difficulties, the preferred embodiment of this invention utilizes a number of different types of atmospheres in the annealing process in order to control the timing and the rate of decarburization and oxidation. Accordingly, the atmospheres and the zones used within the system 10 are very critical to the decarburization and the relative deoxidation of the input powder and this will now be explained.

Specifically, two of the objectives of powder annealing procedures, used in iron powder manufacture, are the lowering of carbon concentration levels to below a level of approximately 0.01 to about 0.03 weight percent, preferably to a level below approximately 0.01 to about 0.02 weight percent, and most preferably to below approximately 0.02 weight percent (denoted as decarburization) and the reduction of oxides formed by the previously occurring comminution or atomization processes. Steel powder, due to the fact that it typically contains silicon and manganese concentrations which are significantly higher than that of the iron powder compositions normally processed into powder, has not been commercially acceptable because of the problem of the simultaneous oxide formation during the decarburization of the steel powder. By discovering the properties of the oxides formed on the steel powders during such a decarburization process, a simultaneous oxidation may be avoided by a proper design of atmospheric compositions and thermal cycles according to the teachings of the preferred embodiment of this invention.

Powder annealing routinely employes mixtures of hydrogen and nitrogen gases with varying moisture concentration to effect decarburization. Water vapor is the active component in these atmospheres. Specifically, the general decarburization reaction may be denoted as follows:

$$C+H_2O_{(g)} \rightarrow CO_{(g)}+H_{2(g)}$$

The extent to which the aforementioned chemical equation or process proceeds to the right is dependent upon several factors. That is, if carbon monoxide, denoted as "CO", is continuously removed, the reaction will continue until no carbon remains in the system. If some residual carbon monoxide partial pressure exists then the extent of the reaction, as denoted above, is controlled by the hydrogen-to-water vapor partial pressure ratio. Finally, temperature is also a consideration both in the driving force of the aforementioned chemical reaction as well as for the rate of diffusion of carbon through the solid particles. This diffusing carbon will move to the surface for reaction with the gas phase.

Secondly, the chemical reaction, as noted above, implies that the rates of decarburization can be increased with high water vapor concentrations. The only constraint is the possibility of simultaneous oxidation of other elements present in steel. For instance, even iron can oxidize in the presence of sufficiently high water vapor concentrations. The goal of the atmospheric control mechanism, in the preferred embodiment of this invention, is thus to selectively oxidize only the carbon and at the maximum rate possible. Specifically, enough oxygen must be present to permit decarburization at a relatively fast rate in order to make the process in the preferred embodiment, relatively efficient, but not enough so as to cause the steel to oxidize.

Figure 2:
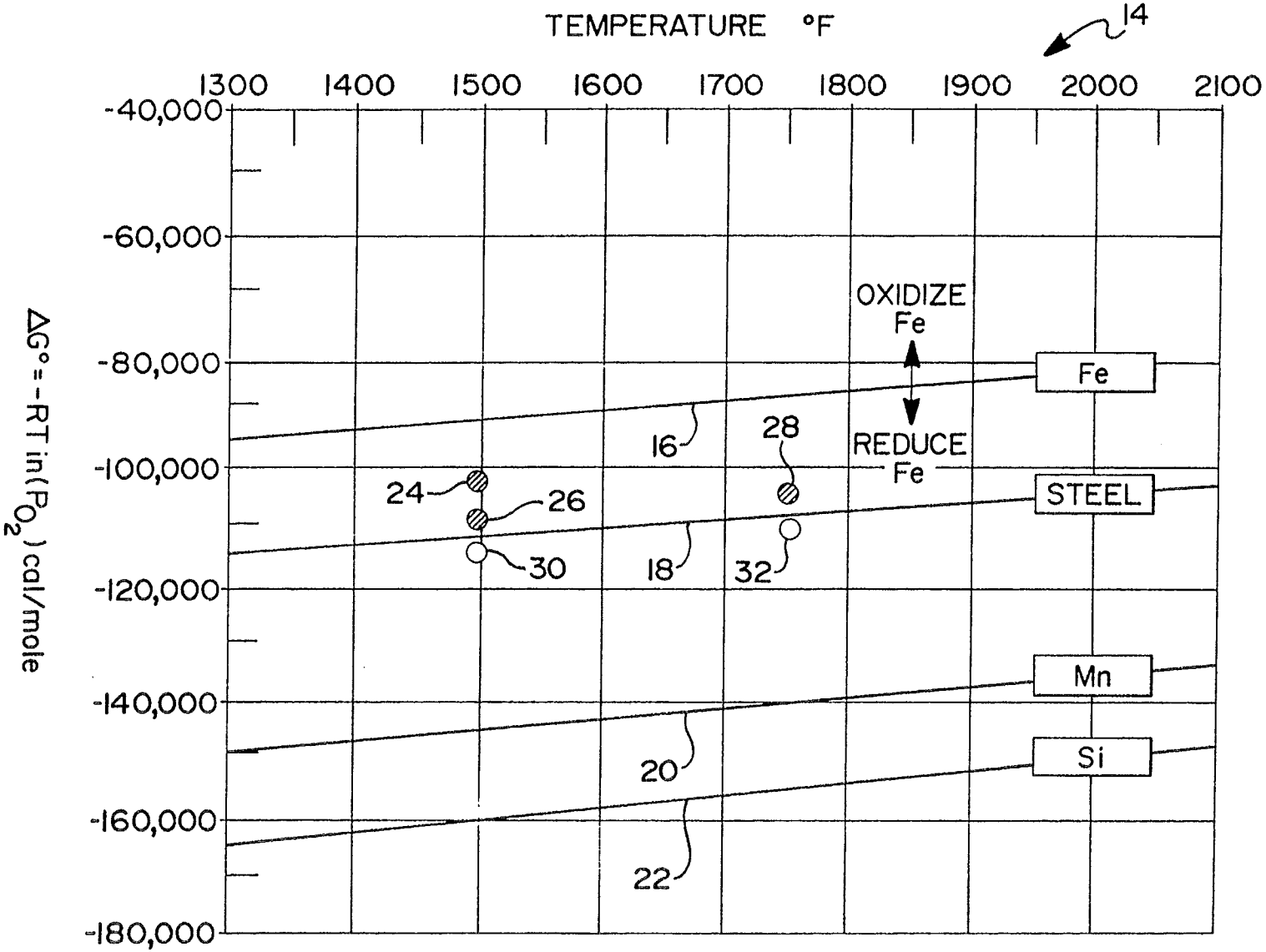
FIG. 2 is a graph showing the relationship between temperature and the free energy of iron, steel, manganese, and silicon.

The conventional method for representing the susceptibility of elements to oxidation as a function of temperature is by use of a Richardson Diagram, as shown in FIG. 2. For the general oxidation reaction the following relationships exist and are shown below.:

$$\frac{X}{Y}(\mathrm{Me}) + \mathrm{O}_{2(g)} = \frac{1}{Y}\mathrm{Me}_x\mathrm{O}_{2y}$$

That is, if both the metal, denoted as "Me" and the oxide are present in their pure or standard state, the standard free energy of the reaction, denoted as "$\Delta G^o$," can be written as follows:

$$\Delta G^o = RTln(p_{o2}) \text{ where}$$

R is the Universal Gas Constant, T is the absolute temperature, and $P_{o2}$ is the dissociation pressure of the oxide $Me_xO_{2y}$. The dissociation pressure "$p_{o2}$" is therefore a measure of the stability of the oxide since it is a measure of the singular oxygen partial pressure at which the pure metal can coexist with its oxide or the pressure where reduction of the oxide can begin. A Richardson diagram, therefore, plots the standard free energy of the reaction for each oxide-metal equilibrium versus temperature.

Referring now to FIG. 2, there is shown Richardson Diagram 14 having curves 16, 18, 20, and 22. Specifically, curve 16 relates to the standard free energy of the aforementioned reaction relative to temperature for iron while curves 18–22 relate the same parameters for steel, manganese and silicon, respectively.

The lower the position of an oxide's stability line or cure 16–22 becomes, as shown in FIG. 2, the more stable the oxide. It therefore can be seen that pure silicon and pure manganese form oxides which are far more stable than the iron oxide since curves 20 and 22 are far lower than curve 16. Also shown in FIG. 2, are data points 24, 26, 28, 30, and 32 which were obtained from experimentation by using a steel powder with approximately 0.6 to 0.7 percent by weight of manganese and about 0.1 percent by weight of silicon. The manganese level was about 3–4 times more than that which is nominally found in commercial iron powders and the silicon level was about then times greater. Data points 24, 26, and 28 represent atmospheric conditions where oxidation was observed and the data points 30 and 32 represent atmospheric conditions where oxidation was not observed. If a line is therefore drawn between points 24, 26, and 28 (parallel to the curve represented by the points 24, 26, and 28) the atmosphere requirements for annealing steel powder without oxidation can be estimated. This estimation was made and used according to the teachings of the preferred embodiment of this invention and will be explained in reference to FIG. 3.

To compute the amount of oxygen, in the form of water vapor, which would cause oxidation of any of the materials, it is only necessary to compute the proportions of hydrogen to water vapor which occur in the following reaction and which would produce the dissociation pressure of the oxide in question:

$$2H_{2(g)}+O_{2(g)}=2H_2O_{(g)}$$

This was done for iron and steel using the data shown in FIG. 2. The atmosphere has been assumed to comprise about 75 percent hydrogen and about 25 percent nitrogen with the water vapor concentration expressed as Dew Points.

Figure 3:
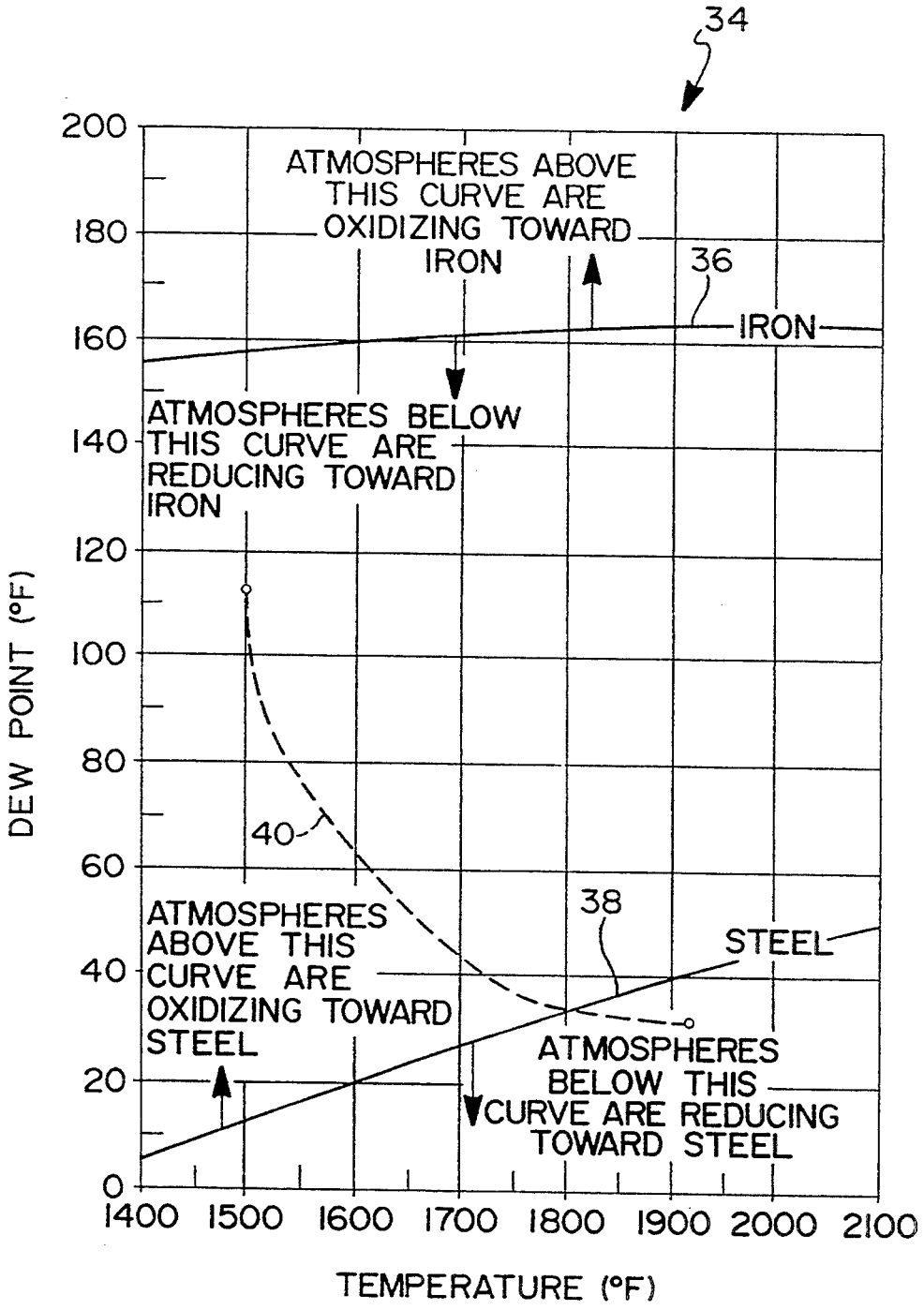
FIG. 3 is a graph illustrating various aspects of the teachings of the preferred embodiment of this invention and specifically showing the relationship between Dew Point and Temperature for both iron and steel.
Figure 4:
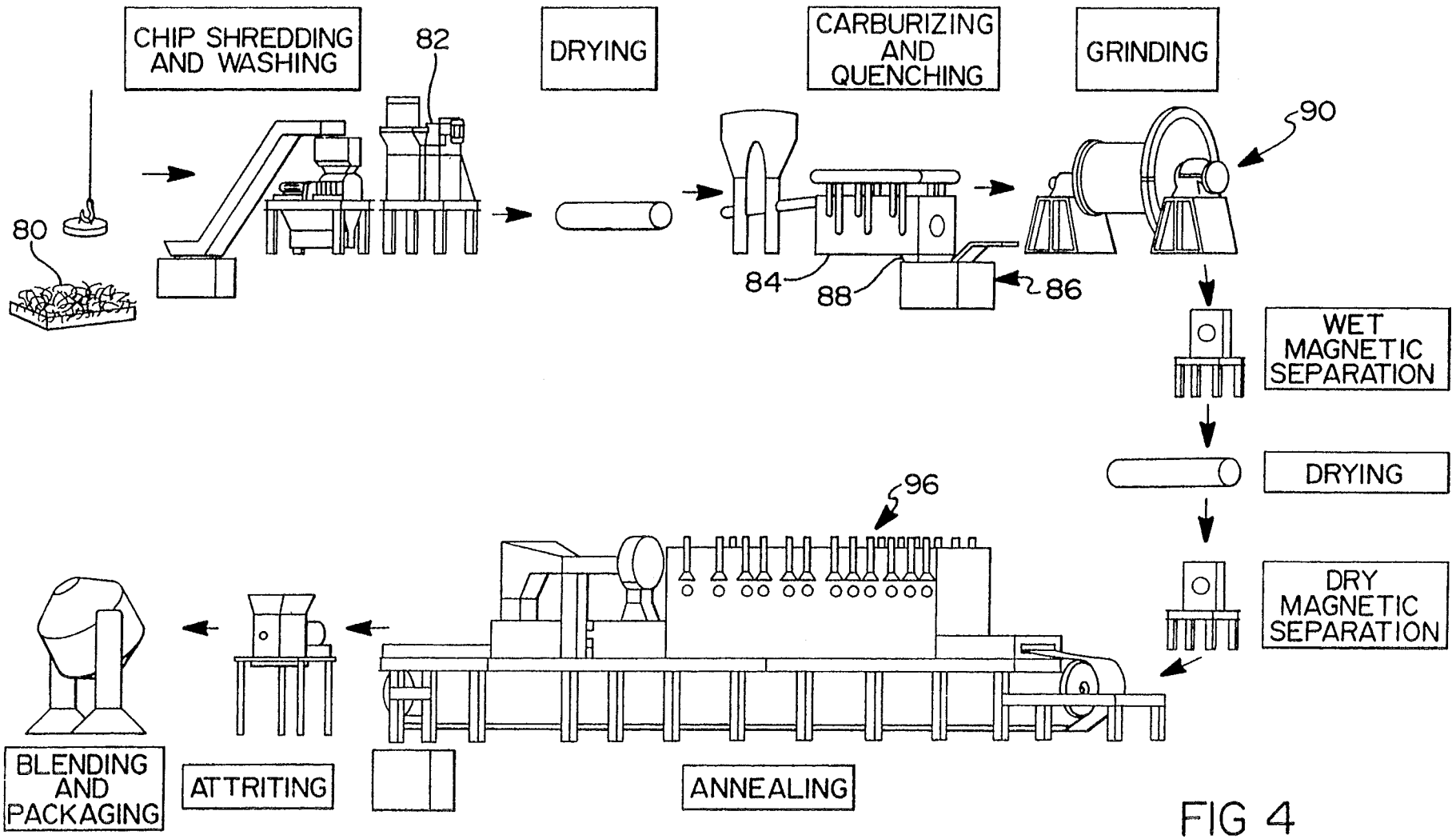
FIG. 4 is a simplified schematic diagram of the steps in the method hereof.

Referring now to FIG. 3, there is shown a graph 34 representing a relationship between various atmospheric Dew Points and temperatures for iron and steel. Curves 36 and 38 are respectively related to iron and steel and were created by use of the estimation done in reference to the atmosphere requirements for annealing steel powder without oxidation, as discussed earlier in reference to FIG. 2. Curves 36 and 38 therefore indicate the highest Dew Points that can be tolerated for each of the materials (iron and steel) as a function of temperature and without oxidation. That is, atmospheres which occur above the curve 36, as shown in FIG. 3, are oxidizing whereas atmospheres which occur at Dew Points below curve 36 are reducing the iron. Similarly, atmospheres having dew points above that shown by curve 38 tend to oxidize the steel while the utilization of atmospheres having Dew Points occurring below the curve 38 tend to reduce the steel.

To compute the relative kinetics in order to compare the annealing of steel to that of iron, it was assumed that system geometries, gas flows, and atomistic mechanisms for decarburization were identical and that the starting carbon concentrations in the powders were the same. Under these assumptions, the relative kinetics should theoretically be proportional to the rate of supply of water vapor to the powder bed. In order to keep the steel from oxidizing during decarburization, water vapor concentrations during annealing must be kept to about 1 percent of that used for iron. Production rates of steel powder annealing must therefore be anticipated at about 1 percent of those attainable for iron powder if any oxidation is to be avoided. However, as seen in FIG. 3, it is possible to run the decarburization process under oxidizing conditions provided that sometime before the annealing is completed, the Dew Point of the atmosphere used is lowered to a value where the oxide will reduce. Typically, an excursion to approximately 1,900° F., keeping Dew Points well below 40° F., would substantially reduce oxygen levels in the powder bed. A possible thermal-dew point cycle for annealing is therefore indicated by the curve 40 in FIG. 3 and this cycle is sued in the preferred embodiment of the invention.

That is, a first stage decarburization is initiated (according to the teachings of the preferred embodiment of this invention) at relatively low temperatures which are in the range of approximately 1300° F. to approximately 1700° F. (700°-925° C.), preferably from approximately 1300° F. to approximately 1600° F. (700°-875° C.), and most preferably from about 1400° F. to about 1500° F. (760°-815° C.). In this temperature range, the decarburization rates are substantially higher than the oxidation rates, as long as an atmosphere having a relatively high Dew Point is used. The higher temperature range is preferred, because while the decarburization rate was observed to be most strongly related to the concentration of the oxidant in the atmosphere, the rate of oxidation remained essentially constant. Short times with high Dew Points favored decarburization. Such initial rapid decarburization resulting in carbon levels of approximately 0.1 percent to about 0.3 percent (preferably from about 0.1 percent to about 0.2 percent) by weight is possible, according to the teachings of the preferred embodiment of this invention, without increasing oxygen levels by more than 0.05 percent by weight (most preferably by no more than 0.02 percent by weight). While the carbon content of the steel powder is sufficiently high, greater than approximately 0.1 percent, the CO gas produced during decarburization provides a protective blanket to avoid excess oxidation of the steel.

The second stage of decarburization, according to the teachings of the preferred embodiment of this invention, involves lowering the Dew Point (i.e., introducing a new atmosphere or modifying an existing atmosphere) to a point closer to the non-oxidation value in order to complete the decarburization to levels below 0.10 percent (preferably to below 0.05 percent) by weight of carbon. Finally, the Dew Point is lowered again (i.e., by changing atmospheric conditions) to about −10° F. (14° C.) to about −50° F. (−46° C.), preferably from about −30° F. (−34° C.) to about −50° F. (−46° C.) and is most preferably approximately −50° F. (−46° C.) and, the temperature is raised to the range of about 1775° F. to about 2100° F., (970° F. to 1150° C.) preferably from about 1875° F. to about 2100° F. (1025° C. to 1150° C.) and most preferably from about 1875° F. to about 2000° F. (1025° C. to 1095° C.) in order to use the reduction of any residual oxides to remove residual carbon. Thus, carbon levels, according to the teachings of this invention, fall to about 0.02 percent by weight or less (i.e., most preferably to about 0.01 percent by weight) without any substantial increase in oxygen levels above those which were already present before annealing began.

This annealing procedure, as shown in FIGS. 2 and 3 is therefore unique in that the procedure is designed specifically for steel powder and is capable of minimizing the exposure of alloying elements to oxidation. This in effect allows retention of essentially all alloying additions to the steel and any slight oxidation which occurs during annealing desensitizes the powder to oxidation during sintering without the need to apply a protective coating. It should be noted that the atmospheres utilized by this invention are comprised primarily of hydrogen, nitrogen, and water vapor. Specifically, the atmospheres, preferably, have approximately 75 percent by weight of hydrogen and 25 percent by weight of nitrogen and water vapor combined.

Referring now to FIG. 1 there is shown a block diagram of the annealing and decarburization apparatus 10 of the preferred embodiment of this invention as having a furnace 42 and a cooling apparatus 44. Furnace 42 has an inlet portion 46 of approximately 8 feet in length and has an output air cooling portion 48 of a length of approximately 4 feet. The total length of cooling apparatus 44, according to the teachings of the preferred embodiment of this invention is approximately 29 feet including a 4 foot output portion 50. It should be realized that this aforementioned lengths may vary with production rates.

Specifically, furnace 42 has pipes 52, 54, 56, 58, and 60, deployed therein. These pipes, respectively, having diameters of 1 inch, 1 inch, 1 inch, 3 inches, and 3 inches, (although other diameters may be used). Additionally, pipe 65, which is coupled to a source of nitrogen, is deployed within furnace 42 in order to prevent air from entering the furnace. Exhaust products exit furnace 42 through pipe 52.

The distance that pipes 54 and 56 extend within furnace 42 is approximately 8 to 15 feet and 8 to 20 feet respectively. Both pipes 56 and 54 are coupled to a source of nitrogen while pipes 58 and 60 are respectively coupled, according to the teachings of the preferred embodiment of this invention, to a mixture of hydrogen and nitrogen gas and to nitrogen gas alone. As the powder moves through the apparatus (i.e. from inlet 46 to furnace 42), pipes 54 and 56 create the desired atmospheric Dew Point conditions by simply outputting nitrogen gas containing some water vapor along their length in accordance with the illustration FIG. 3. In order to change and/or alter the Dew Point conditions (i.e. from that shown in FIG. 3) the length of the pipes 54 and 56 may be changed or the water content of the gas allowed to enter these pipes 54 and 56 can be adjusted. Cooler 44 also has a pipe 62 deployed therein which is coupled to a source of nitrogen gas in order to seal cooler 44 from air.

In order to obtain the necessary decarburization shown in FIG. 3, the furnace 42, in the preferred embodiment of this invention, is segregated into five separate heating zones denoted zones 64, 66, 68, 70, and 72. Specifically, the length of these zones (in feet) is 6, 12, 6, 16, and 8 respectively (although other lengths may be used depending upon production rates). Zones 64–72 are used, respectively, for the following functions: heating; decarburization, heating, reduction, and reduction, according to the curve 40 shown in FIG. 3. Furthermore, depending upon the belt speed used within system 10, the time that an individual particle of the powder remains in a given zone is given by the following table:

TABLE 3

Time in Zone (Minutes) Versus Belt Speed

| | Belt Speed | | |
|---|---|---|---|
| | 4" Per Minute | 8" Per Minute | 12" Per Minute |
| Zone 1 | 18 | 9 | 6 |
| Zone 2 | 36 | 18 | 12 |
| Zone 3 | 18 | 9 | 6 |
| Zone 4 | 48 | 24 | 16 |
| Zone 5 | 24 | 12 | 8 |

Therefore, by varying the speed of the belt in accordance with Table 3 above and through the use of zones 64–72 as explained herebefore, the powder may be placed within a needed atmospheric condition for a desired period of time such that needed decarburization may occur without significant oxidation for the final powder product in accordance with the graph 40 as shown in FIG. 3. Therefore, the final powder produced will have characteristics which will enable it to produce very desirable high tensile high strength tooling materials since the carbon content and the oxygen content of this powder is minimized and it should be evident from the foregoing description that powders comprising titanium, manganese, silicon, vanadium, colombium, and/or chromium may be utilized by system 10 in the aforedescribed manner, without oxidizing these additives to a point where the powder becomes unsuited for subsequent sintering operations.

The present invention provides an annealing process for carbon steel powder where little or no oxidation takes place during the decarburization phase.

The reactions of concern in decarburizing ferrous powders are:

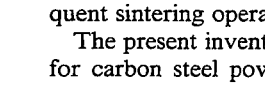

$$H_2O+C=CO+H_2$$

and

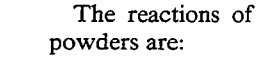

$$CO+H_2O=CO_2+H_2$$

By supplying sufficient water vapor these reactions can be driven to the point where all of the carbon can be removed from solution in iron. However, at some point, conditions will be present where oxidation of iron and other substitutional alloying elements can take place. The objective is to find conditions necessary to maximize decarburization rates while avoiding oxidation. To accomplish this the partial pressure ratios of $CO/CO_2$ and $H_2/H_2O$ can be set at values derived from known oxide dissociation pressures for steel powder.

For the equilibrium conditions where oxide just becomes stable, the following relations can be written:

$$K_H=\left[\frac{P_{H2}}{P_{H2O}}\right]=\left[\frac{n_{H2}}{n_{H2O}}\right] \quad (1)$$

$$K_C=\left[\frac{P_{co}}{P_{CO2}}\right]=\left[\frac{n_{co}}{n_{co2}}\right] \quad (2)$$

where $p_i$ is the partial pressure of the $i^{th}$ species and $n_i$ is its mole concentration. In addition, from the materials balances for carbon, oxygen and hydrogen:

$$n_c=n_{c(in)}=n_{co}+n_{co2}+n_c \quad (3)$$

$$n_H=2[n_{H2}+n_{H\,20}](in)=2[n_{H2}+n_{H20}] \quad (4)$$

$$n_o=n_{H20(in)}=n_{H20}+n_{co}+2n_{co2} \quad (5)$$

The values of $n_c$, $n_h$, and $n_o$ are fixed by the chemistry and mass charge rate of the metallics and the composition and flow rate of the atmosphere fed into the annealing system. The five simultaneous equations can be solved for $n_{H20(in)}$, in terms of the change in carbon concentration $n_c$ and $n_{H2(in)}$ $$n_{H2O(in)}=\Delta n_c\left[\frac{(K_c+2)(K_H+1)}{K_H(K_c+1)}\right]+\left[\frac{n_{H2(in)}}{K_H}\right] \quad (6)$$

This relationship can then be used to compute the supply of water vapor necessary to decarburize steel with just enough oxidation potential to begin forming the oxide as well, i.e., the upper limit of water supply to prevent oxidation.

Decarburization of steel is accomplished at temperatures where only superficial (surface) oxide formation can occur and carbon diffusion is rapid enough to allow the reaction to proceed to completion in relatively short periods of time. From actual laboratory experiments the temperature range of 1300° to 1700° F. (700° to 925° C.) appears to be sufficient for this purpose. Complete decarburization can be achieved in times under one hour with minimal oxidation; the oxide is capable of being subsequently reduced in dry hydrogen at temperatures between 1775° and 2100° F. (970° to 1150° C.). The ideal anneal would involve complete decarburization in this temperature range without any oxidation. To do this the supply of water vapor at each stage of the process must be balanced with the carbon still present and with the dissociation pressure of the oxide.

Consider an annealing process designed to decarburization steel powder using wet hydrogen. Assume that the decarburization rate is independent of powder bed depth and is controlled only by the rate of water vapor supply. To provide maximum water vapor supply to the steel powder the flow of wet hydrogen must be counter-current to the flow of powder. Instead of balancing water at all points in the process only two decarburization zones will be considered, the first where carbon is brought from its initial value in the material down to 0.1 to percent by weight, and the second where the carbon is further reduced to 0.01 percent by weight.

Assume one ton of material/hour containing 0.6 percent carbon is to be decarburized in a wet hydrogen stream with a hydrogen flow of 1000 Standard Cubic Feet Per Hour (SCFH). Decarburization temperature in both zones will be 1550° F. The equilibrium pressure ratios $K_H$ and $K_c$ are 250 and 220 from FIG. 1. Equation (6) produces the following results for each of the zones:

Zone 1:

$$n(H_2O)_{in}=0.852 \text{ moles/hr}=306\ SCFH,$$

and

Zone 2:

$$N(H_2O)_{in}=0.162 \text{ moles/hr}=58\ SCFH.$$

The present invention employs the above atmosphere technology for fine adjustments to final carbon and oxygen chemistry, the bulk of the decarburization being accomplished by reaction of residual oxides in the metal with carbon from the steel to form CO. To accomplish this, the preoxidation step can be employed if the residual oxygen is too low. The amount of oxygen added to the powder during the preoxidation is predicated on the stoichiometry of the decarburization reaction.

From stoichiometry, the theoretical amount of oxygen which must be present in the form of oxide to convert all dissolved carbon to carbon monoxide is 1.33 times the weight percent carbon present, since the atomic weight of oxygen is 1.33 times the atomic weight of carbon. Thus for steel powder with 0.6 percent C, the amount of oxygen required to completely convert the carbon to carbon monoxide would be 1.33 times that or 0.8 percent. Mechanistically the process would occur in two steps:

$O(\text{in oxide}) + H_2(\text{gas}) \rightarrow H_2O(\text{gas})$ $C(\text{in steel}) + H_2O(\text{gas}) \rightarrow CO(\text{gas}) + H_2(\text{gas})$ The rate controlling step, based upon measured rates of both of these reactions at decarburizing temperatures, would be the first reaction shown.

The formation of this oxide must therefore be confined to the surfaces and near surface regions of particles in order to ensure rapid and complete reduction of the oxide. There are two reasons for such a limitation. First and foremost is to limit the physical amount of alloying element involved in the oxidation so the oxide remains relatively unstable in a hydrogen atmosphere; secondly to limit diffusion distances which oxygen in the oxide must traverse to access the hydrogen atmosphere during reduction. Practically, this can be achieved by preoxidizing at temperatures below 1500° F. Oxides formed on ordinary carbon steels below this temperature have been found to be completely reducible in hydrogen at temperatures below 2000° F.

A precaution to be observed in any preoxidation process would be control of the large evolution of heat from this reaction. Excessive heat build up and the resultant undesirable temperature increases can be avoided by lowering the oxygen potential of the oxidizing atmosphere. Controlled preoxidation can be accomplished easily during the grinding operation by grinding in an atmosphere comprising of air mixed with nitrogen, for example, in the right proportions to create the desired carbon/oxygen ratio.

Alternatively, and in accordance herewith, the preoxidation may be done post-grinding and prior to annealing. Such a controlled preoxidation may be achieved by incorporating a preheat zone in the annealing furnace where oxygen/carbon ratios can be adjusted with proper atmospheres while the powder is heating up to 1500° F. This preheat zone can also be used for lowering oxide content if the carbon/oxygen ratio is too low.

There are two advantages of using a preoxidized material for annealing as compared to the previously disclosed methods. First, kinetics are more rapid since oxygen supply is always in intimate contact with the material to be decarburized. Second, the process shuts itself off without any further oxidation since the carbon and oxygen concentrations are balanced; any residual oxide will be reduced by the hydrogen once all of the carbon has been removed.

Although the present invention has been described with respect to preferred embodiments thereof, it will be understood that the foregoing description is intended to be illustrative, and not restrictive. Many modifications of the present invention will occur to those skilled in the art. All such modifications which fall within the scope of the appended claims are intended to be within the scope and spirit of the present invention.

Having, thus, described the invention, what is claimed is:

1. A method for producing abrasive grit from steel particles comprising the steps of:

(a) heating clean, dry steel particles in a non-oxidizing protective atmosphere at a temperature of about 1500° F. to about 1800° F.;

(b) transporting the particles through a chute submerged below a quenching solution, the quenching solution forming an atmospheric seal;

(c) bathing the heating steel particles in the quenching solution which comprises water to embrittle the particles, and (d) grinding the steel particles in a mill to form the grit.

2. The method of claim 1 wherein the mill is either a ball mill, a hammer mill, a dry vibratory mill, a rod mill, or a ring crusher.

3. The method of claim 1 further comprising the step of reheating the grit, after grinding, in a substantially inert atmosphere to temper the grit.

4. The method of claim 1 wherein the heating step comprises loading the particles into foraminous trays and sequentially pushing the trays through a furnace.

5. The method of claim 1 wherein the heating step comprises passing the particles through a rotating cylindrical retort furnace.

6. The method of claim 1 wherein the protective atmosphere comprises a gaseous carbon-containing compound which diffuses into the particles.

7. An abrasive grit which is a product of the method of claim 1 the grit having a size of form about 0.075 mm to about 2.0 mm.

8. The method of claim 1 wherein the particles are recycled steel scrap.

9. The method of claim 3 wherein the tempering is at a temperature of from about 315° C. to about 650° C.

10. A method of producing a steel powder which is suitable for use in sintering operations, comprising the steps of:

(a) heating clean, dry steel particles, having a carbon content, in a non-oxidizing protective atmosphere at a temperature of about 1500° F.;

(b) adjusting the carbon content of the particles to a value in a range of about 0.3 weight percent to about 1.2 weight percent;

(c) bathing the heated steel particles in a quenching solution which comprises water to embrittle the particles;

(d) grinding the particles in a grinder in a first controlled atmosphere to produce a first product; and (e) annealing the first product in a second controlled atmosphere to adjust the hardness of the product, and, wherein the first controlled atmosphere is an oxidizing atmosphere which preoxidizes the powder and further wherein the second controlled atmosphere is substantially inert and the powder is heated to a temperature effective to cause the oxidized portion of the powder to react with the carbon content of the powder to substantially reduce said carbon content.

11. A method of decarburizing ferrous metal while substantially preventing the oxidation of the metal, said method comprising the steps of:

(a) placing said metal in a first reducing atmosphere having a first dew point;

(b) partially decarburizing said metal by heating said metal to a first temperature for a first predetermined period of time such that the rate of decarburization of said metal is substantially greater than the rate of oxidation of said metal;

(c) placing said metal into a second atmosphere having a second and substantially lower dew point associated therewith;

(d) partially decarburizing said metal by heating said metal to a second and higher temperature for a second predetermined period of time, said second temperature being slightly greater than the temperature at which said metal will reduce;

(e) placing said metal into third atmosphere having a third dew point which is substantially lower than said second dew point; and (f) heating said metal to a third temperature which is substantially higher than said second temperature for a third predetermined period of time whereby oxides of said metal are reduced and then oxide reduction is effective to remove any residual carbon remaining within said metal.

12. The method of claim 11 wherein each of said first, second and third atmospheres comprises hydrogen and nitrogen.

13. The method of claim 11 wherein each of said first, second, and third atmospheres to contain approximately 75 percent, by weight, of hydrogen and 25 percent, by weight, of nitrogen.

14. The method of claim 11 wherein said metal comprises steel powder.

15. The method of claim 11 further comprising the step of defining said first predetermined time to be longer than said second predetermined time.

16. The method of claim 11 further comprising the step of defining said second predetermined time to be longer than said third predetermined time.

17. The method of claim 11 further comprising the step of defining said first temperature to be between about 1300° F. and 1500° F. (705° to 815° C.).

18. The method of claim 11 further comprising the step of defining said third temperature to be between 1875° F. and 2000° F. (1025° to 1095° C.).

19. A method of decarburizing ferrous metal having a certain amount of an oxidizable nonferrous metallic constituent therein while substantially preventing the oxidation of the metal, said method comprising the steps of:

(a) placing said metal in a first atmosphere having a first dew point;

(b) partially decarburizing said metal by heating said metal to a first temperature for a first predetermined period of time such that the rate of decarburization of said metal is substantially greater than the rate of oxidation of said metal;

(c) placing said metal into a second atmosphere having a second and substantially lower dew point associated therewith;

(d) partially decarburizing said metal by heating said metal to a second and higher temperature for a second predetermined period of time, said second temperature being slightly greater than the temperature at which said metal will reduce;

(e) placing said metal into a third atmosphere having a third dew point substantially less than said second dew point; and (f) heating said metal to a third temperature which is substantially higher than said second temperature for a third predetermined period of time whereby oxides of said metal are reduced and this oxide reduction is effective to remove any residual carbon remaining within said metal.

20. The method of claim 19 further comprising the step of defining said third temperature to be between 1875° F. and 2000° F.

21. The method of claim 19 further comprising the step of defining said third dew point to be approximately −50° F.

22. The method of claim 19 wherein the nonferrous metallic constituent is selected from the group consisting of manganese, silicon, chromium, vanadium, titanium, and mixtures thereof.

23. The method of producing a steel powder which is suitable for use in sintering operations, comprising the steps of:

(a) heating clean, dry steel particles, having a carbon content, in a non-oxidizing protective atmosphere at a temperature of about 1500° F. to about 1800° F.;

(b) adjusting the carbon content of the particles to a value in a range of about 0.3 weight percent to about 1.2 weight percent;

(c) bathing the heated steel particles in a quenching solution which comprises water to embrittle the particles;

(d) grinding the particles in a grinder in an oxidizing atmosphere to produce a partially oxidized powder;

(e) preheating the first product in an oxidizing atmosphere at a temperature below a temperature for annealing, the preheating preoxidizing the first product;

(f) annealing the powder in a substantially inert atmosphere to cause the oxidized portion of the powder to react with the carbon content whereby carbon content.

* * * * *